United States Patent [19]

Sommerfeld

[11] 4,324,056

[45] Apr. 13, 1982

[54] WIPING DEVICE FOR A DITCH DIGGING MACHINE

[76] Inventor: Gerhard Sommerfeld, Verbindungsweg 1, 2905 Edewecht/Friedrichsfehn, Fed. Rep. of Germany

[21] Appl. No.: 162,971

[22] Filed: Jun. 25, 1980

[30] Foreign Application Priority Data

Jun. 25, 1979 [DE] Fed. Rep. of Germany ... 7918437[U]

[51] Int. Cl.[3] ..... E02F 5/08

[52] U.S. Cl. ..... 37/94; 37/189; 37/DIG. 2

[58] Field of Search ..... 37/DIG. 2, 91-97, 37/189, 190

[56] References Cited

U.S. PATENT DOCUMENTS 883,017 3/1908 Heck ..... 37/DIG. 2

2,711,035 6/1955 Pitts ..... 37/DIG. 2

*Primary Examiner*—Clifford D. Crowder

*Attorney, Agent, or Firm*—Allison C. Collard; Thomas M. Galgano

[57] ABSTRACT

A device for wiping or removing stones, or the like, especially intended for a ditch digging machine, having at least one digging blade which is mounted on a horizontally disposed, rotatable shaft, includes a wiper endpiece mounted on the shaft, which is disposed parallel to and a short distance apart from the digging blade. This endpiece is mounted in a slip clutch-like manner on the shaft and is maintained in its normal position by engagement with a spring-loaded rocker arm.

4 Claims, 5 Drawing Figures

WIPING DEVICE FOR A DITCH DIGGING MACHINE

The present invention relates to a device for wiping or removing stones or the like, especially intended for use in association with a ditch or trench digging machine, having at least one digging blade, which is mounted on a generally horizontally-disposed rotatable shaft.

Ditch or trench digging machines serve to improve the ground. These machines practically replace digging done manually by means of a spade.

In known ditch digging devices, wiping means are mounted at the rear of the device which, as seen in the operating direction, are disposed radially with respect to the rotating digging blades. These wiping means serve to wipe or strip off earth, half-rotted plant remains, stones and other similar ground impurities which adhere to the digging blade.

Wood pieces and stones which are in the ground, are brought to the surface by the cutting blades which cut into the ground, run parallel with respect to the working machanism and strike against the wiping means. In known ditch digging machines, the wiping device is relatively rigidly dimensioned in a rigid coupling with the ditch digging machine. Therefore, stone and wood pieces may get jammed between the digging blades and the wiping elements during the digging operation, so that a digging blade or the wiping element, or both, may be simultaneously bent. Consequently, a further use of the ditch digging machine would only be possible after repairing the same. Since a functional operation of the digging machine is not possible without wipers, the operational safety of the known digging machines is rather low, especially if one encounters stones in the ground.

It is therefore an object of the invention to provide a wiping device which includes a wiper endpiece, which is mounted on the rotatable shaft of the ditch digging device in a slip clutch-like manner, and is disposed slightly spaced from and parallel to the digging blade and which, in its normal position, engages a spring-loaded rocker arm.

During the operation of the digging machine, the wiping endpiece is pushed by the friction forces generated by the rotating shaft against the spring-loaded rocker arm with a predetermined moment, whereby the wiping endpiece may execute its normal wiping function. However, as soon as a larger, foreign body is jammed between the rotating digging blades and the wiping endpiece, the moment pushing against the rocker arm is additionally increased by the drive moment of the digging blades, whereby the rocker arm pivots around a pivot point by overcoming the spring load. The sliding friction between the rotating shaft and the slip clutch-like mounting bearing of the wiper endpiece is transformed into a friction coupling when the wiper endpiece is released by the pivoted rocker arm, so that the entire wiper, together with the rotating digging blades, rotate together with the rotating shaft.

As soon as the wiper endpiece is disengaged from the rocker arm, the rocker arm returns to its original position, due to the release of the spring load, so that the wiper again comes into engagement with the rocker arm after finishing a complete rotation of the rotating shaft, with the stone or piece of wood having dropped off the wiper during its rotation.

The inventive release of the wiper endpiece in a moment before any damage to it could occur, considerably increases the operating safety of the device. A particularly simple construction is characterized in that bearing support means of the wiper endpiece includes two half-shells, which are disposed for engagement with the rotating shaft and which are provided on their interior surfaces with continuously adjustable friction linings. Preferably, the half-shells are coupled with each other by means of bolts, which are under axial spring tension. This is advantageous in that the engagement of the half-shells against the rotating shaft, and thereby the slip clutch-like friction moment, can be easily adjusted. In addition, the spring tension permits an easy and automatic adjustment of the friction lining during wear of the same.

In accordance with a preferred embodiment of the invention, the wiping endpiece is coupled by means of wiping arms, mounted at the ends of the wiping endpiece, with one of the half-shells. These arms are conically tapered towards the half-shell, so that a widened slot is provided between the conically tapered wiper arms and the rotating digging blades in the direction of the rotating shaft, through which a strange body can easily fall.

Furthermore, it is preferable that the mounting means for the rocker arm be provided outside of the rotating circle or arcuate path of the digging blade, and that an abutment be mounted on the wiping endpiece which extends in direction towards and meets the rocker arm. The abutment is held in this abutment position by the rocker arm until it reaches the chosen maximum load.

This embodiment is advantageous because the entire release machanism is outside of the pivoting circle of the cutting blades, so as to permit a manual adjustment or readjustment of the rocker arm in relation to a desired release torque or moment without any danger, even during the operation of the device. The adjustment of the release torque may be executed by an adjustment screw, for example, with which the spring is released, so as to provide a defined pretension on which the release torque of the rocker arm depends.

Other objects and features of the present invention will become apparent from the following detailed description, considered in connection with the accompany drawings which disclose a single embodiment of the invention. It is to be understood, however, that the drawings are designed for the purpose of illustration only and not as a definition of the limits of the invention.

In the drawings, wherein similar reference characters denote similar elements through the several views.

Figure 1:
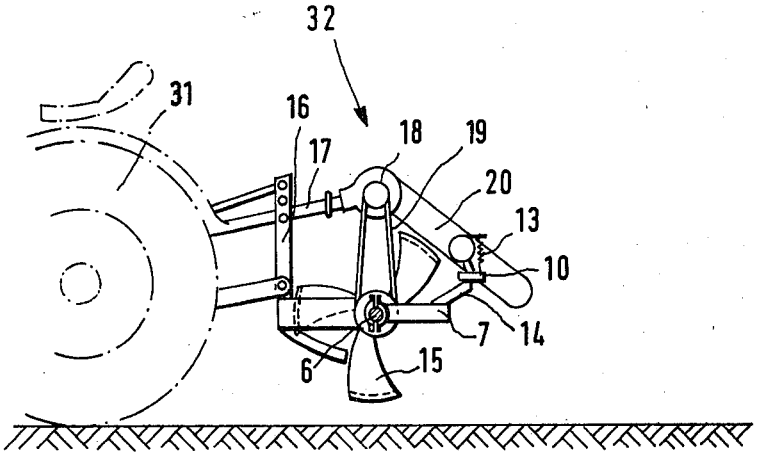
FIG. 1 is a schematically-illustrated, side view of the rear part of a tractor, to which is attached a ditch digging device in which the inventive wiping device is incorporated.

Turning now in detail to the drawings, FIG. 1 shows the rear portion of a tractor 31, to which is attached a ditch digging machine 32 by means of a common threepoint attachment or coupling. A plurality of digging knives or blades 15 are mounted on a rotatable shaft 6, which is held in position by means of a retaining member 16. The rotatable shaft 6 is driven by means of a pinion shaft 17, drive means 18 and an associated V-belt 19.

The wiping means has two wiper arms 7 and 8, which are mounted in a slip clutch-like manner on shaft 6. At the free end of the wiper device, an abutment 14 is mounted, which pushes against rocker arm 10 which is pivotable about a pivot point against the tension of spring 13. Rocker arm 10 and spring 13 are carried by a cantilever frame 20, which is directed away from drive 18 in a rearward, downwardly oblique disposition.

Figure 2:
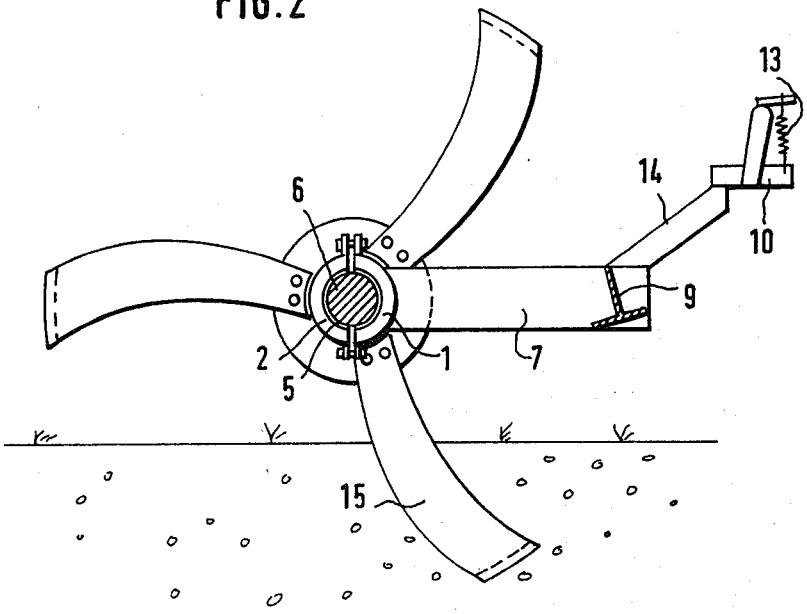
FIG. 2 is an enlarged, schematically illustrated, side view showing the digging blades and the inventive wiping device mounted on a rotatable shaft.

FIG. 2 illustrates this device in greater detail and in an enlarged view. FIG. 2 also illustrates how the wiper means is mounted on rotatable shaft 6 by means of two half-shells 1 and 2, which are provided on their interior surfaces with friction linings 5.

Figure 3:
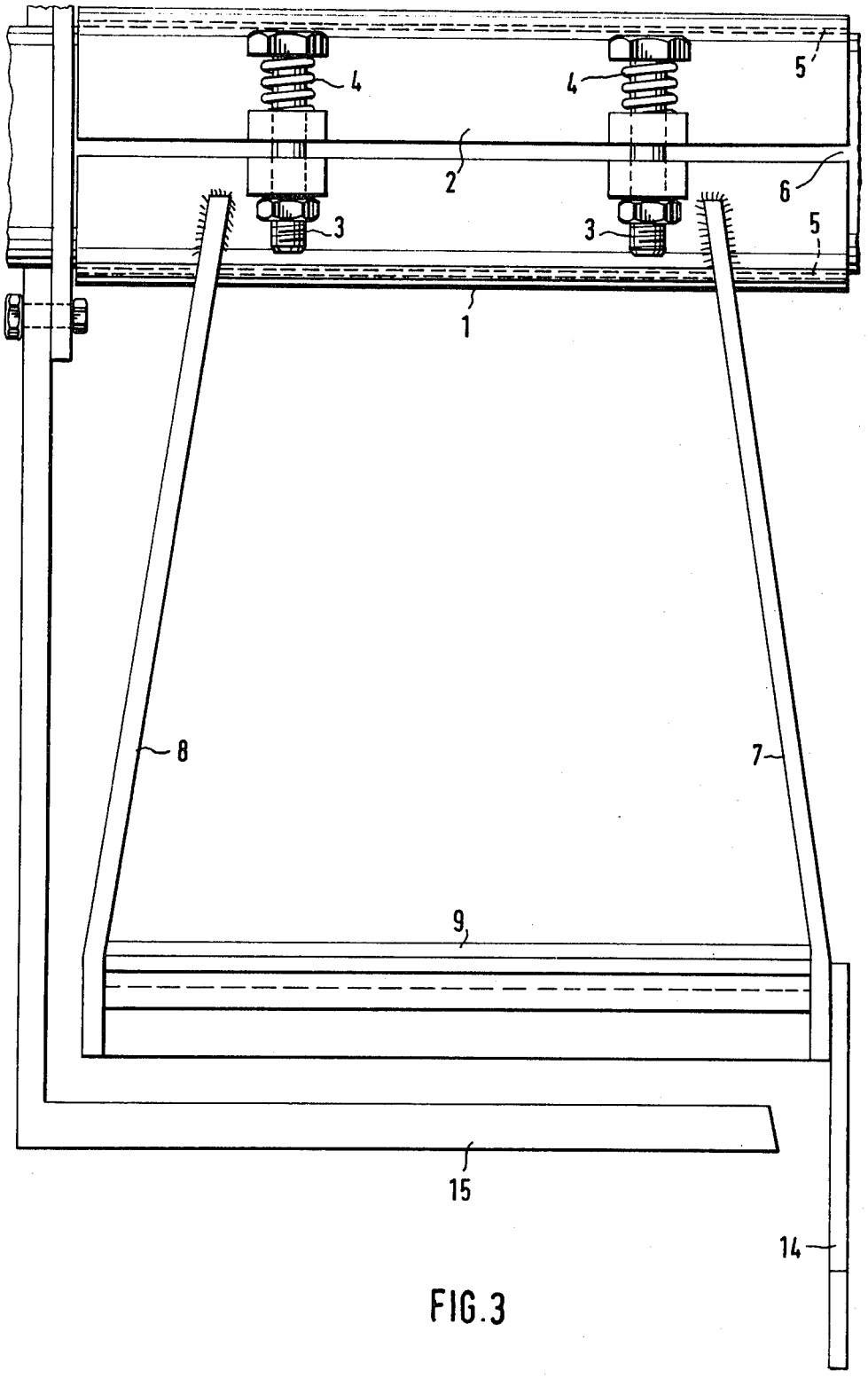
FIG. 3 is a further enlarged, schematically-illustrated plan view of the wiping device and a digging blade mounted on the rotatable shaft.

FIG. 3 is a plan view of shaft 6 with the mounted two half-shells 1 and 2, which are drawn or pulled toward each other by threaded bolts 3, so as to increase the friction on rotatable shaft 6. A tension spring 4 is provided for each threaded bolt, which assures uniform pressure of the half-shells against the rotatable shaft. Wiper arms 7 and 8 are welded onto half-shell 1 and extend radially therefrom. They are provided at their ends with the actual wiper endpiece 9, which has a T-shaped cross-sectional profile. Digging blade 15 is also mounted on shaft 6.

Figure 4:
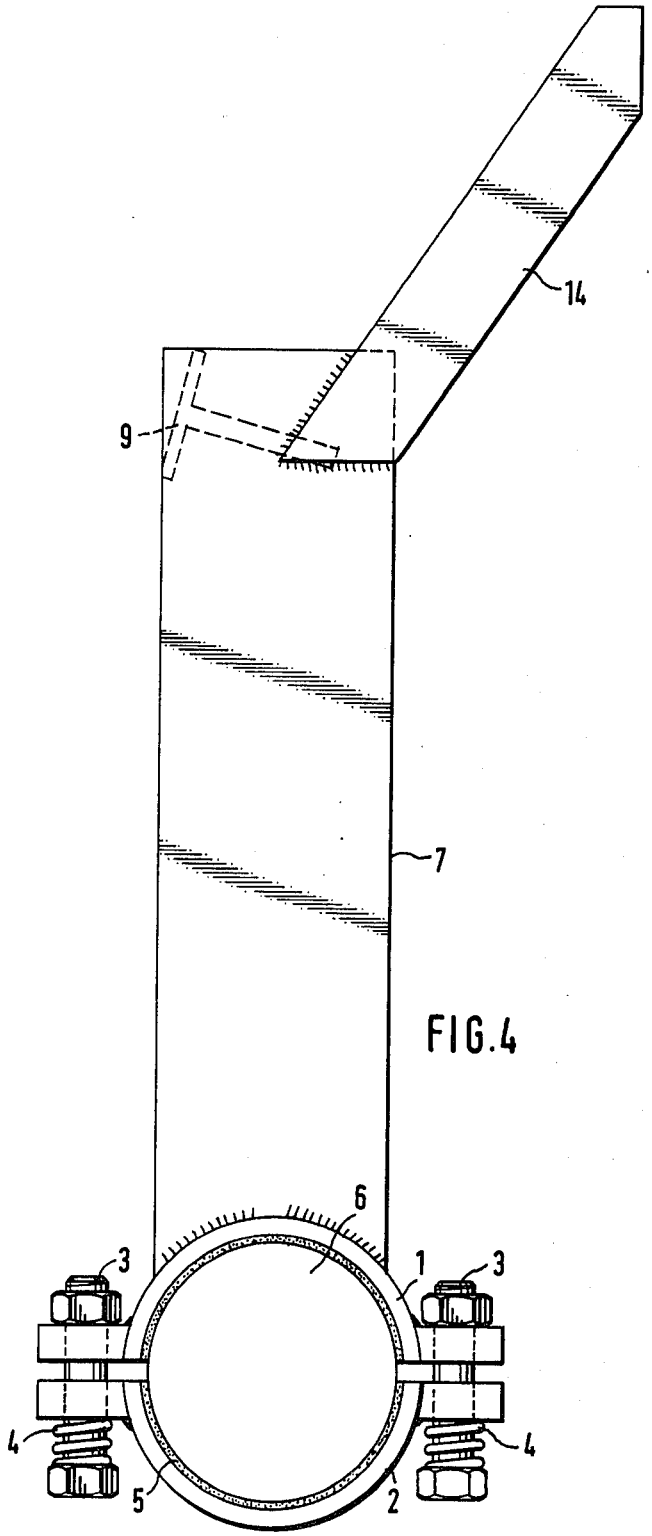
FIG. 4 is an enlarged, schematically-illustrated side view of the wiping device.

FIG. 4 is a side view of the two half-shells 1 and 2 also showing wiper arm 7 and endpiece 9, which is retained thereon. Also illustrated is a welded-on plate which acts as abutment 14, by which wiper arms 7 and 8, together with the wiper endpiece 9, are supported against rocker arm 10.

Figure 5:
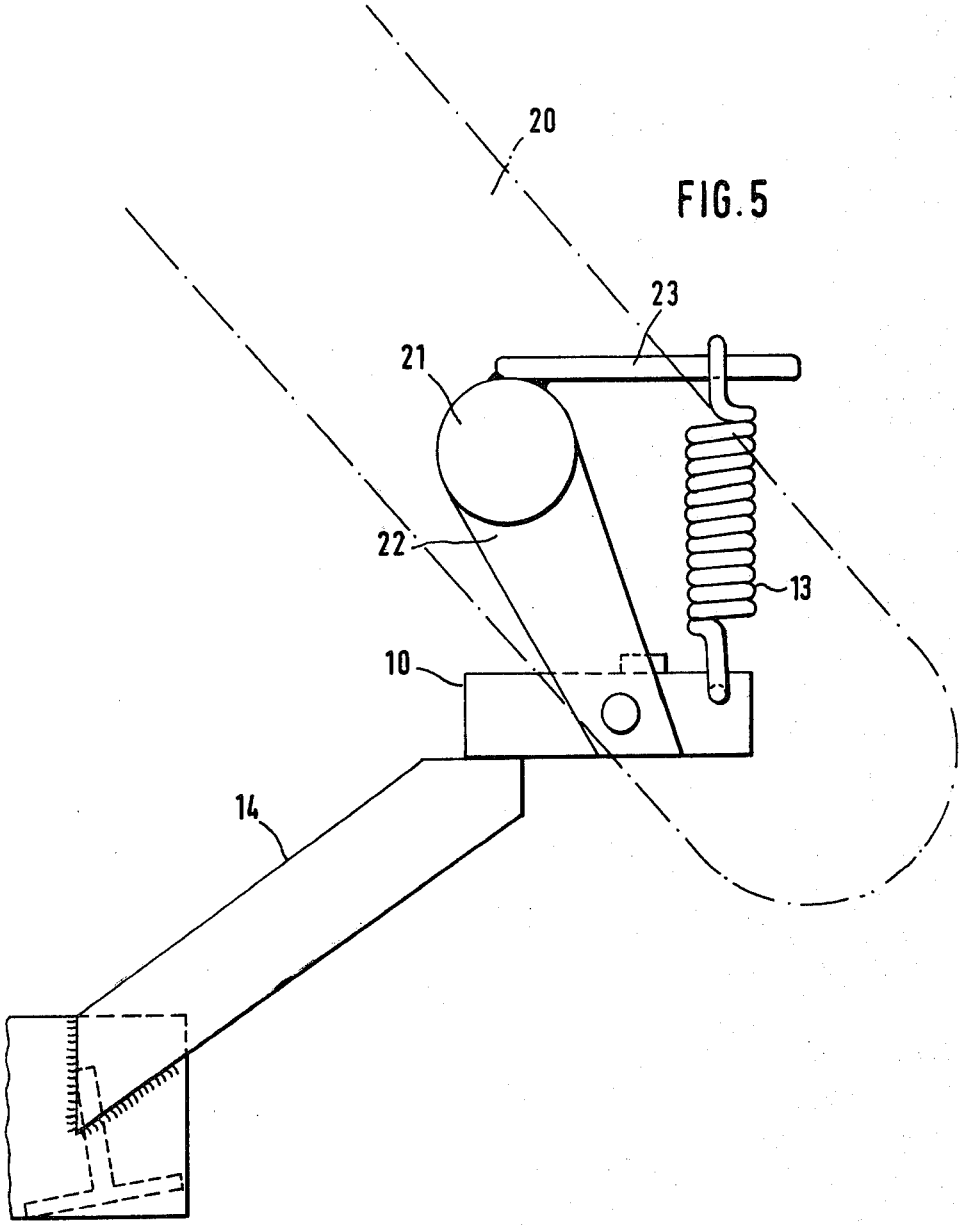
FIG. 5 is an enlarged, schematically-illustrated side view of the release mechanism for the wiping device.

This rocker arm is schematically shown in FIG. 5. A laterally-extending support rod 21 is mounted on cantilever frame 20, and is provided with a support plate 22 at the free end of which rocker arm 10 is pivotably mounted. The rocker arm is in the shape of a two-armed lever, with abutment 14 of the wiper arms abutting against one lever arm, while the other lever arm is attached to one end of tension spring 13, which is mounted on support plate 23.

The device operates as follows: Half-shell 1 of the wiping device is coupled with half-shell 2 in such a way the bolts 3, together with their associated pressure springs 4, pull the two half-shells against each other with equal force, so that friction linings 5 within the half-shells, engage with constant force against rotating shaft 6. This ensures that during the rotation of the shaft, the wiper is always in operating position in abutment with rocker arm 10, during the operation of the ditch digging machine. If a foreign body is brought to the surface by digging blade 15 and jams between digging blade 15 and either wiper arm 7 and 8 or wiper endpiece 9, a force is transmitted to tension spring 13 by means of the rocker arm, which force pivots the rocker arm when a predetermined value is reached. Thereupon, the entire wiper executes a full rotation, together with the rotating shaft, and the digging blades, thereby wiping off the foreign body and returning to its original position, whereby the abutment again engages or abuts the rocker lever arm.

Thus, while only a single embodiment of the present invention has been shown and described, it will be obvious that many changes and modifications may be made thereunto, without departing from the spirit and scope of the invention.

What is claimed is:

1. A device for removing stones or the like, for use in association with a ditch digging machine having at least one digging blade mounted on a generally horizontally-disposed rotatable shaft, comprising:

a wiper endpiece;

bearing means for mounting said wiper endpiece on said shaft, such that it is spaced a relatively short distance away from said blade in a substantially parallel manner thereto, comprising two opposing half-shells which engage and together encircle said shaft and which are provided on their interior surfaces with continuously adjustable friction linings; and a spring-loaded rocker arm disposed to engage and releasably retain said endpiece in a normal operating position.

2. The device according to claim 1, wherein said half-shells are coupled with each other by means of bolts, which are under axial spring tension.

3. The device according to claims 1, or 2, wherein said wiper endpiece has a pair of opposite ends which are coupled by means of a pair of wiping arms with one of said half-shells, said arms tapering inwardly towards said one half-shell.

4. The device according to claims 1 or 2, additionally including mounting means for said rocker arm which is disposed outside of the circular path of said digging blade, and wherein an abutment is mounted on said wiper endpiece, which extends towards and engages said rocker arm, said abutment being held in an abutment position by the rocker arm until a predetermined maximum load is applied thereto.

* * * * *